US007062810B2

(12) United States Patent
Hardaway et al.

(10) Patent No.: US 7,062,810 B2
(45) Date of Patent: Jun. 20, 2006

(54) METHOD FOR WASHING VARYING CLOTHES LOADS IN AUTOMATIC WASHER USING COMMON WATER LEVEL

(75) Inventors: Anthony H. Hardaway, Stevensville, MI (US); K. David McAllister, St. Joseph, MI (US); Carrie Ann Dickinson, St. Joseph, MI (US); Duane M. Kobos, Laporte, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 316 days.

(21) Appl. No.: 10/141,890

(22) Filed: May 9, 2002

(65) Prior Publication Data

US 2003/0208852 A1 Nov. 13, 2003

(51) Int. Cl.
*D06F 33/02* (2006.01)

(52) U.S. Cl. ..... 8/159

(58) Field of Classification Search ..... 8/158–159; 68/12.02, 12.04, 12.12, 131–134
See application file for complete search history.

(56) References Cited

U.S. PATENT DOCUMENTS

| | | | | |
|---|---|---|---|---|
| 5,271,251 | A * | 12/1993 | Kovich et al. | 68/171 |
| 5,507,055 | A * | 4/1996 | Blauert et al. | 8/159 |
| 6,212,722 | B1 | 4/2001 | Pinkowski et al. | 8/158 |
| 6,269,666 | B1 | 8/2001 | Whah et al. | 68/12.02 |
| 6,584,811 | B1 * | 7/2003 | Whah et al. | 68/12.04 |
| 6,591,439 | B1 * | 7/2003 | Whah et al. | 8/159 |

* cited by examiner

*Primary Examiner*—Joseph L. Perrin
(74) *Attorney, Agent, or Firm*—John F. Colligan; Robert O. Rice; Stephen Krefman

(57) ABSTRACT

A method to wash varying clothes load sizes with the same level of water is provided for a washer having a controller. A clothes load size setting signal is received in the controller. A mechanical duty cycle is set through the controller as a function of the clothes load size setting signal. A high-concentration wash step may be performed where a wash basket of the washer is spun at certain speeds while a highly concentrated wash bath solution is sprayed, extracted, and re-sprayed over the clothes load. On the completion of this high-concentration wash step, the washer is filled to a common water level regardless of the clothes load size setting signal. The clothes load is then processed through a wash cycle until completed.

26 Claims, 3 Drawing Sheets

METHOD FOR WASHING VARYING CLOTHES LOADS IN AUTOMATIC WASHER USING COMMON WATER LEVEL

BACKGROUND OF THE INVENTION

The present invention relates generally to washers and more particularly to a washer that uses a single, fixed fluid level to wash small, medium, and large clothes load sizes.

A washer typically is a home appliance for washing clothes and other loads automatically. A conventional washer (sometimes referred to as a washing machine) includes system controls and a waterproof wash tub having a sump area that acts as a reservoir for fluid. Within the wash tub may be located a perforated wash basket. The wash basket holds a clothes load while the perforations permit fluid to flow into and out of the wash basket. Inside the wash basket may be an impeller to aid in moving the clothes load through the fluid. Consumers typically use various compositions of fluids and solutions inside the washer, with water solutions being most commonly seen in practice.

The use of a washer is relatively straightforward. After a consumer fills the wash basket with clothes, the consumer typically makes a few decisions before starting the load. For example, the consumer may decide how big the load is (small, medium, large, extra large), what temperature the water will be for the wash and rinse cycles (cold/cold, warm/cold, warm/warm, hot/cold), and the type of clothes load (delicate, knit, permanent press, heavy). The consumer also may decide how long the wash and rinse cycles should last (number of minutes, usually based on how soiled the clothes are) and how much detergent to add.

After setting the washer controls, adding detergent, and pressing a start button, the machine fills the tub with a volume of fresh water according to the selected load size, among other factors. The fresh water mixes with the detergent to create a bath of wash liquid. The impeller moves and flexes the clothes in the wash liquid to remove soil from the clothes. After some time passes, the washer drains the wash liquid and soil. A motor spins the perforated wash basket to remove most of the remaining wash liquid from the clothes. Then, the system may refill with fresh water one or more times and move the clothes more to rinse the clothes clean. The machine then drains the rinse liquid and spins the perforated wash basket again to produce clean clothes. At any time during this washing or rinsing process, a recirculation pump may spray wash liquid over the clothes for better cleaning action.

From an energy standpoint, a washer cleans clothes through chemical, mechanical, and thermal energy. Detergent in water solution provides the chemical energy that acts to remove and suspend soils. The impeller movements (and sometimes a recirculation pump) provide mechanical energy into the clothes and water. The water transmits impeller mechanical energy to the clothes. Heated water provides thermal energy that may act directly on the soil. An increase in the level of any of these three forms of energy will generally improve the cleaning capability of the washer up to some level. For example, an increase in the amount of detergent (an increase in the chemical energy) would improve the cleaning capability of the washer.

Increasing the chemical, mechanical, or thermal energy level of a washer may require that the level of one of the remaining two forms of energies be altered. Conventionally, altering the level of one of the remaining two forms of energies means moving it away from its preferred level to a less than desirable level. In particular, problems arise when this trade-off in applied energy involves the chemical and mechanical forms of energy.

For the wash liquid, there conventionally are two approaches to improving chemical energy. Both approaches involve increasing detergent concentration; that is detergent-to-water ratio. One way is to add more detergent to a given volume of fresh water. However, this is undesirable since it increases consumer detergent costs. A second way is to decrease the volume of fresh water used for the same detergent amount that consumers are accustomed to using. Consumers prefer this low water bath method since it saves water resources and does not require them to alter their detergent habits. However, two problems result when increasing detergent concentration by lowering the volume of fresh water used: over-suds and over-torque.

Over-suds is an excess build-up of soapsuds. One cause is the use of too much mechanical energy from the impeller or from a recirculating pump. Over-sudsing may reduce the overall cleaning performance since the detergent used to create the excessive soapsuds is not available for removing soil from the clothes. Over-sudsing may also cause 'suds lock.' Suds lock is a buildup of sudsy fluid in the wash tub and sump. As the sudsy fluid fills the area between the sides of the wash basket and the wash tub, these suds cause a significant drag force on the spinning wash basket. With suds lock, the drag forces may be greater than the forces that the motor may provide. This may stop the wash process prematurely.

Over-torque refers to an excess amount of torque force needed by the impeller to move the water and clothes. In a deep fill washer system, a large amount of water causes the clothes to become buoyant and float up and away from the impeller, thereby minimizing the impeller's direct influence on the clothes movement. In a low fill washer system, there is a loss of buoyancy lift, which puts more clothes in contact with the impeller, thereby increasing the impeller's direct influence on the clothes movement. This may result in a higher torque required to move the impeller. When over-torque conditions exist, the motor may not be able to provide the required torque forces, and the wash process may be prematurely stopped.

A low fill washer system typically is preferred because it conserves water resources. The over-suds and over-torque problems for a low fill washer system have been addressed in the industry by a trade-off between chemical and mechanical energy forms. In other words, where a washer manufacturer increases the detergent concentration by using a low water bath, a decrease in the overall mechanical energy conventionally meets this increase in chemical energy.

One way to reduce the overall mechanical energy imparted into the wash liquid bath is to pulse the energy applied to the recirculation pump during recirculation. This causes less agitation of the wash liquid and, in turn, less suds. However, this results in an uneven saturation of the clothes load. Alternatively, the drive system of the impeller may be powered for a shorter on-time or supplied with power for fewer times during a wash or rinse cycle. However, a change in the time that power is supplied to the impeller relative to the total wash time alters the 'duty cycle' of the washer system. Decreasing the duty cycle of the system reduces the average torque imparted by the impeller into the wash liquid. Although this reduces the tendency to over-suds, the reduction in mechanical energy results in a reduced clothes motion. In turn, the reduction in the motion of the clothes may degrade the cleaning performance on certain soils, especially with larger loads. Accordingly, conventional decrease in the overall mechanical energy to address the over-suds and over-torque problems in low fill washer systems has resulted in its own set of problems that still need to be resolved.

SUMMARY OF THE INVENTION

In light of the above-noted problems, the present invention works toward providing a system that permits utilization of a single water level for washing varied-load sizes. Here, the inventors successfully achieved the development of such a system while experiencing several surprises along the way. It was found that such a system is more forgiving to consumer control entry mistakes, allows for an increase in detergent concentration without a corresponding increase in over-suds and over-torque, and provides a most efficient water usage system over the life of the washer.

Thus, in a preferred embodiment, a method to wash varying clothes load sizes with the same level of water is provided for a washer having a controller. The controller receives a clothes load size setting signal. A mechanical duty cycle is set through the controller as a function of the clothes load size signal setting. A high-concentration wash step may be performed. On the completion of this high-concentration wash step, the method fills the washer to a common water level regardless of the clothes load size signal setting. The method then processes the clothes load through a wash cycle until completed.

Setting the mechanical duty cycle comprises setting at least one of a recirculation duty cycle or an impeller oscillation cycle. In one embodiment, the recirculation fluid flow is pulsed. In this same embodiment, the impeller oscillation cycle is fixed and symmetric. In an alternate embodiment, the impeller oscillation cycle is varied such as by employing random strokes for the impeller oscillation cycle. During the wash cycle, the mechanical duty cycle may be augmented as a function of the load sensing device signal by signals received from a load sensing device signal at the controller.

The high-concentration wash step involves spinning a wash basket of the washer at certain speeds while a highly concentrated wash bath solution is sprayed, extracted, and re-sprayed over and through the clothes load. This process is continued until the clothes load is saturated with the wash liquid. Due to the spinning of the wash basket, the clothes load will have been plastered onto the inside of the wash basket. The clothes will need to be pulled down to the wash basket bottom, where the clothes may be acted upon by the impeller mechanical energy.

In pulling down the clothes load from a side of the wash basket, the amount of wash liquid in a wash tub of the washer is increased by adding fresh water to the wash tub. An impeller of the washer is oscillated. Oscillating the impeller works towards splashing a lower layer of the clothes load with the wash liquid to aid in pulling down the plastered clothes load.

If the clothes load is at least a predetermined size, such as a large load, the recirculation pump may be activated again to spray the clothes load with the wash liquid. If a predetermined duration for oscillating the impeller has not been reached, then the controller continues to oscillate the impeller. Once the predetermined duration for oscillating the impeller has been reached, the washer is filled to the common water level and the wash cycle completed.

These and other objects, features, and advantages of the present invention will become apparent upon a reading of the detailed description and a review of the accompanying drawings. Specific embodiments of the present invention are described herein. The present invention is not intended to be limited to only these embodiments. Changes and modifications may be made to the described embodiments and yet fall within the scope of the present invention.

DETAILED DESCRIPTION OF THE PREFERRED EMBODIMENTS

Vertical-axis washers include a wash basket that spins about a vertical-axis. Horizontal-axis washers include a wash basket that spins about a horizontal-axis. Other washer constructions have an axis tilted between vertical and horizontal.

Figure 1:
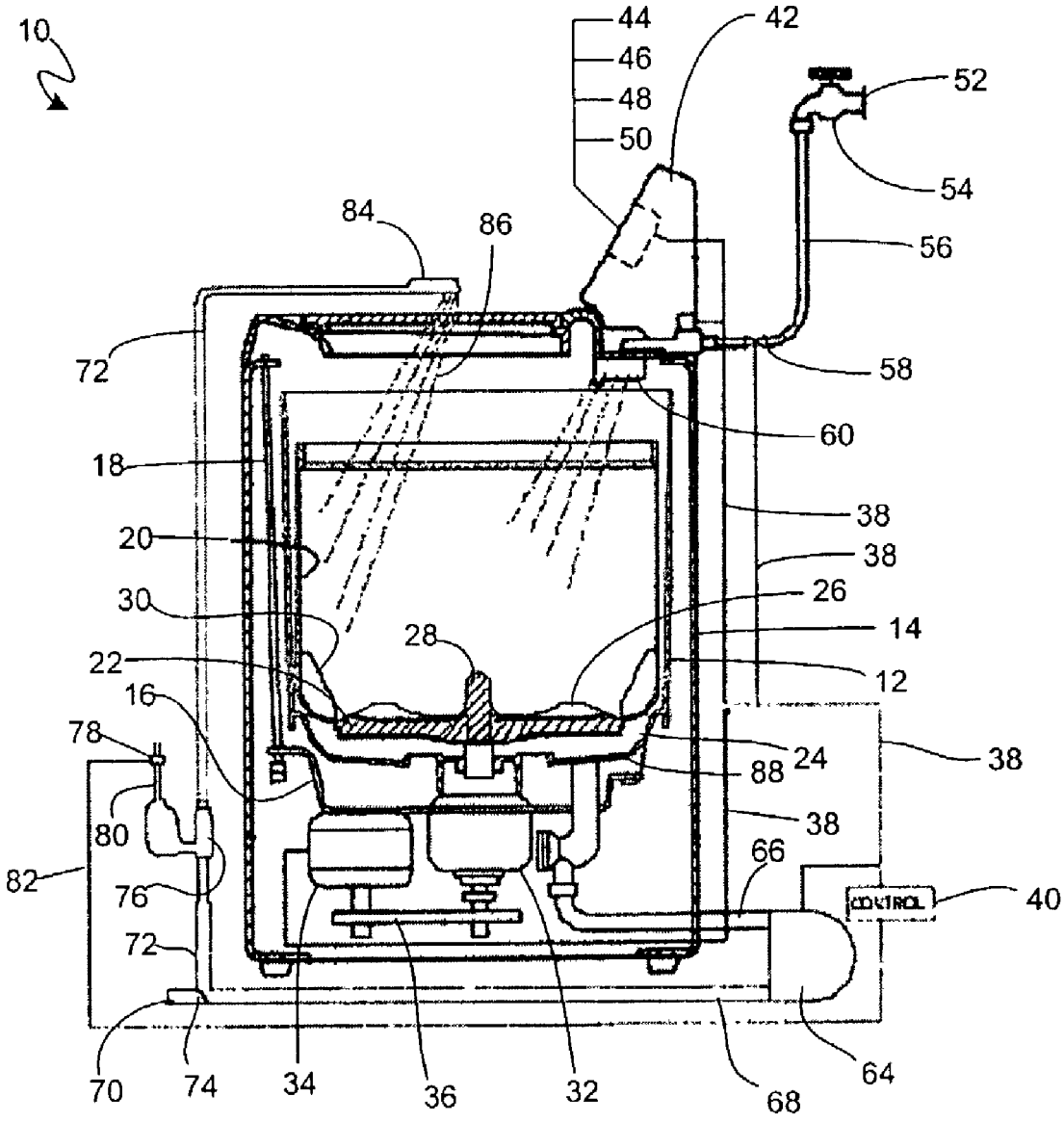
FIG. 1 is a schematic side sectional view of a washer, partially in elevation.

The present invention is particularly useful for a vertical-axis washer of the type disclosed in FIG. 1 and thus the preferred embodiment will be disclosed in this environment, although the invention is not so limited. In fact, the present invention may be utilized in other types of washers such as horizontal-axis or tilted-axis, as well as any other fluid-employing appliance that is motor driven.

A particular type of vertical-axis washer is disclosed in U.S. Pat. No. 6,212,722, a patent that is owned by the assignee of this patent and the disclosure of which is hereby incorporated by reference to the extent permitted by law. The type of machine disclosed therein may be referred to as a VARI machine. A VARI machine may be thought of as a vertical-axis washer with impeller that provides for inverse toroidal rollover of a clothes load. At the time the present invention was made, U.S. Pat. No. 6,212,722 and the present invention were subject to the obligation of assignment to the assignee of U.S. Pat. No. 6,212,722.

Traditionally, vertical-axis washers use a deep fill washing in conjunction with oscillations from a vertically-extending agitator or a low-lying impeller to promote the mechanical clothes motion known as rollover. Most washers use an increasingly proportionate amount of fresh water to wash increasing load amounts. However, the invention in U.S. Pat. No. 6,212,722 surprisingly attains the desired rollover with reduced volumes of wash liquid, preferably by using an impeller rather than an agitator.

In U.S. Pat. No. 6,212,722, it was understood that certain clothes-load-to-water-volume ratios would not produce the desired rollover either due to too little buoyant force or due to too much buoyant force acting on the clothes load. Thus, U.S. Pat. No. 6,212,722 demonstrated a conventional belief that an increasing clothes load size required an increase in water volume to obtain desired clothes motion. In other words, before the instant invention, there was no known technique to use a common, single water level bath to wash different clothes load sizes in a vertical-axis washer.

After detailed investigation into this area, the inventors have discovered a system that permits use of a single water level for washing varied load sizes. Here, the inventors successfully achieved the development of such a system while experiencing several surprises along the way. It was found that such a system (i) is more forgiving to consumer control entry mistakes, (ii) allows for an increase in detergent concentration without a corresponding increase in over-suds and over-torque, and (iii) provides a most efficient water usage system over the life of the washer.

In particular, a preferred embodiment of the present invention is directed to washing varied load sizes using the same, common water level for each load. This may be achieved by modifying at least one of (a) the impeller oscillation profile and (b) the wash liquid recirculation duty cycle. This modification may be as a function of inputs, such as the input settings from a consumer and measured variables from a washer 10. Before reaching the common water level, the washer may be partially filled to create a concentration wash liquid and to perform a high-concentration wash step. The result is a washer that performs well and conserves water resources by using a consistent amount of water, regardless of a consumer's clothes load or water level selection.

I. Washer 10

FIG. 1 is a schematic side sectional view of a washer, partially in elevation. The washer 10 may be any appliance for washing clothes loads automatically. As a washer, the washer 10 may include a wash tub 12 to hold a reservoir of wash liquid for washing operations. The wash tub 12 may be connected to a cabinet structure 14 through a frame 16 and a weight/pulley system 18. The weight/pulley system 18 may support the weight of the heavy components of the washer 10, letting them move without shaking the entire machine. A dampening system (not shown) uses friction to absorb some of the force from any resulting vibrations.

The washer 10 may also include a wash basket 20 and an impeller 22. The wash basket 20 holds the clothes load and has an impeller 22 in the middle of it. The sides of the wash basket 20 may be perforated with holes so that when the wash basket 20 spins, water leaves the wash basket 20 by centrifugal force. The leaving water enters an area referred to as a tub sump 24. The tub sump 24 includes that area between an exterior of the wash basket 20 and an interior of the wash tub 12. The tub sump 24 plays an important part in permitting wash liquid to reside.

The impeller 22 may include impeller protrusions 26 that are fixed to the upper surface of the impeller 22. The combination of the impeller 22 and the impeller protrusions 26 may aid in the inverse toroidal rollover of a clothes load. Here, the impeller protrusions 26 may work with a surface of the impeller 22 to draw adjacent parts of lower clothes articles radially inward towards a raised center 28 as the impeller 22 is rotated about the raised center 28. As adjacent parts of lower clothes articles move radially inward, that part of the clothes which is exterior to the impeller 22 is pulled inward towards the raised center 28 from its exterior position. The pulling inward movement is aided by protrusions 30 that extend inward from the wash tub 12. The effect is to leave an open gap in the outskirts of the impeller 22 into which higher positioned clothes articles move down into and fill. The action of drawing adjacent parts of lower clothes articles radially inward towards the raised center 28 and drawing the higher positioned articles down sets up a clothes motion that would follow around the surface of a doughnut-shaped object. The direction of this toroidal motion at the bottom of the wash basket 20 from the perimeter of the impeller 22 to the raised center 28 is inverse to conventional washer toroidal motions. This inverse toroidal motion technique is more fully explained in U.S. Pat. No. 6,212,722.

The wash basket 20 vibrates and shakes during a wash cycle due to changes and variations in the clothes load weight distribution. Thus, the wash basket 20 needs to be mounted in a way that lets it move around without banging into other parts of the washer 10. Here, the wash basket 20 and the impeller 22 may be attached to a gearbox 32, which may be attached to the frame 16 shown in FIG. 1.

The gearbox 32 includes a power transmission system that aids in controlling the rotary speed and acceleration of the wash basket 20, independently of controlling the rotary speed and acceleration of the impeller 22. The frame 16 additionally may hold a motor 34 that is connected to the gearbox 32 by a belt 36 as an indirect drive system. Alternatively, the washer 10 may employ a direct drive power transmission system.

In operation, the impeller 22 may rotate back and forth as defined by an oscillation profile having a plurality of impeller oscillation cycles. Three variables may identify the impeller oscillation cycle: the stroke angle, the angular acceleration of the impeller 22 as it oscillates, and the stroke time. As discussed in more detail below, a common water level for washing varying loads may be achieved through variations in the oscillation profile of the impeller 22. To provide the appropriate signals to implement these variables, a line 38 to a controller 40 may connect to the motor 34. The line 38 may be configured to transfer signals from a first location to a second.

The controller 40 may include circuitry that, for a given input, produces a predetermined output. In one embodiment, the controller 40 may be preprogrammed with instructions to produce a predetermined output signal based on input signals. In another embodiment, the controller 40 is part of a computer. In yet another embodiment, the controller 40 may be connected to the Internet to receive and send remote signals. As is generally known, the Internet is an interconnected system of networks that connects computers around the world via a standard protocol. Accordingly, a consumer or technician may be at a location remote from the washer 10 and yet communicate with the controller 40 over the Internet.

A machine-readable medium includes any mechanism to store or transmit information in a form readable by a machine (e.g., a computer). For example, a machine-readable medium includes read-only memory (ROM); random access memory (RAM); magnetic disk storage media; optical storage media; flash memory devices; electrical, optical, acoustical or other form of propagated signals (e.g., carrier waves, infrared signals, digital signals, etc.). Methods in accordance with the various embodiments of the invention may be implemented by computer-readable instructions stored in any media that is readable and executable by a computer system. For example, a machine-readable medium having stored thereon instructions which, when executed by a set of processors, may cause a processor of the controller 40 to perform the methods of the invention.

Some of the signals input into the controller 40 may be derived from washing instructions input into the washer 10 by a consumer. For example, a consumer may input washing instructions through setting buttons, knobs, and the like positioned on a console 42. Here, a consumer may input how big the load is (small, medium, large, extra large) through a load size setting 44, what temperature the water will be for the wash and rinse cycles (cold/cold, warm/cold, warm/warm, hot/cold) through a water temperature setting 46, and the type of clothes load (delicate, knit, permanent press, heavy) through a clothes type setting 48. The consumer also may input how long the wash and rinse cycles should last (number of minutes, based on how soiled the clothes are) through a timing sequence setting 50 and determine how much detergent to add. The washing instruction signals from the consumer may be communicated to the controller 40 through the line 38.

During periods of automatic washer operation, liquid 52 may be supplied into the washer 10 from an external source 54. Liquid 52 may include chemicals suspended in a fluid substance. Preferably, liquid 52 is connected to the washer 10 as a hot water and a cold water supply. One way to make this fluid connection is through a fresh water hose 56, a flow valve 58, and a fresh water inlet nozzle 60. Here, the flow valve 58 may be connected to the controller 40 through the line 38. This connection may control the inlet of fresh water into the washer 10 as it passes through the fresh water hose 56 to the fresh water inlet nozzle 60.

In operation, gravity will cause wash liquid to collect in the tub sump 24. Under some circumstances, it may be desirable to bring this wash liquid to an upper surface of a clothes load. For this purpose, the washer 10 may also include a recirculation system.

The recirculation system may include a pump 64 connected through a sump hose 66 to the tub sump 24. The pump 64 also may be connected to the controller 40 by line 38. The controller 40, according to a recirculation duty cycle, may control the pump 64. A preprogrammed recirculation duty cycle may be augmented through signals received by the controller 40 after the start of the recirculation duty cycle.

The pump 64 may work to pump wash liquid from the tub sump 24 via a pump outlet hose 68 either to a drain hose 70 or a recirculating hose 72, depending on the position of a bidirectional valve 74. With the bi-directional valve 74 closing off the drain hose 70, recirculating wash liquid passing through the recirculating hose 72 may be directed to a pressure dome 76.

The pressure dome 76 may be configured to capture a dome of air. This dome of air is maintained in contact with recirculating wash liquid by the wash liquid exerting a pressure on the captured dome of air. Here, the pressure dome 76 provides a channel for this captured air to keep in contact with a pressure sensor 78 through a pressure line 80. Air pressure information from the pressure dome 76 may be communicated between the pressure sensor 78 and the controller 40 as an air pressure signal through a signal line 82. Because of this arrangement, the value of the air pressure signal is a function of the sensed pressure of the recirculating wash liquid.

Here, as recirculating wash liquid passes the pressure dome 76, the pressure dome 76 may communicate the air pressure to the pressure sensor 78 that, in turn, may communicate air pressure information to the controller 40. Moreover, the recirculating hose 72 may deliver a recirculating wash liquid 86 as a head of water pressure to a recirculation spray nozzle 84. This recirculating wash liquid 86 may then be sprayed on top of a load of clothes according to the recirculation duty cycle as augmented by information from the pressure sensor 78.

During the wash cycle, it may be desirable to provide a head of water pressure to the recirculation spray nozzle 84 as a function of the amount of wash liquid contained in the washer 10. To achieve this, the pressure sensor 78 may provide signals such as on/off signals, a varying signal, or a dynamic signal to the controller 40. By sensing the air pressure within the pressure dome 76, the amount of recirculating wash liquid 86 in the washer 10 may be inferred. A higher pressure represents a greater amount of recirculating wash liquid 86 in the washer 10. A lower pressure represents a lesser amount of recirculating wash liquid 86 in the washer 10.

The controller 40 may also receive a static pressure signal from a load sensing device 88 to determine the level of wash liquid within the wash tub 12. The load sensing device 88 may be a fill pressure sensor or a transducer dome connected to the wash tub 12. Alternatively, where the amount of recirculating wash liquid 86 in the washer 10 is at a constant, predetermined level, the value of that predetermined level may be used. Under either technique, the level of wash liquid within wash tub 12 may be used to determine the amount of free water in the wash tub 12 and in the recirculation system during a recirculating wash. Thereby, the amount of clothing actually in the washer may be inferred, in comparison to the signal from the load size setting 44. This information may be useful to minimize energy usage during a common water level wash step and to minimize water and energy usage during a high-concentration wash step.

II. High-Concentration Wash Step

During the outset of the wash cycle, it may be desirable to provide an initial chemical step, or high-concentration wash step, to improve cleaning performance during the remainder of the wash cycle. This basically involves spinning the wash basket 20 at a certain speed while spraying, extracting, and delivering the recirculating wash liquid 86 as a highly concentrated wash bath solution over the clothes load through the spray nozzle 84.

Figure 2:
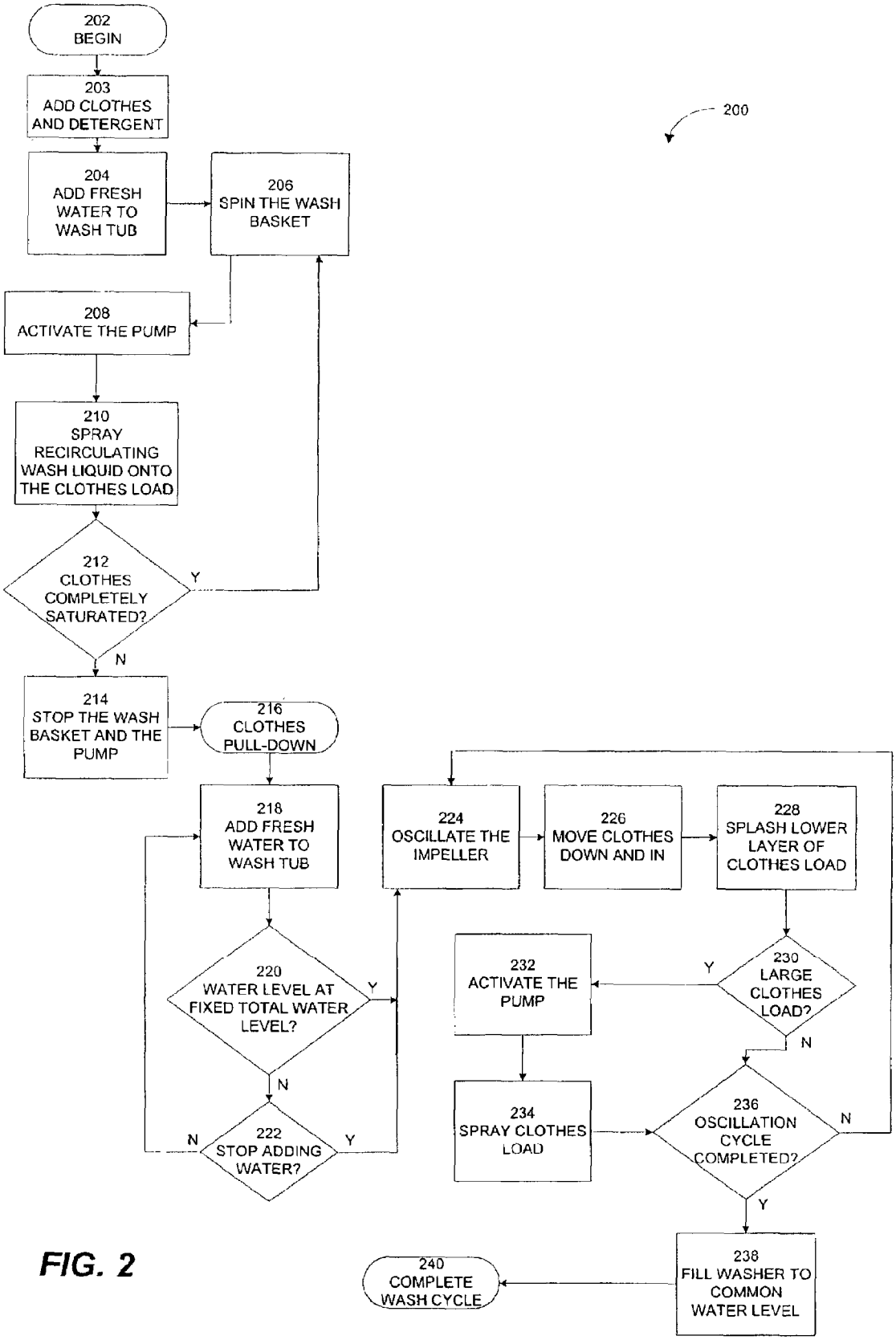
FIG. 2 is a block diagram illustrating a method 200 of the invention to improve cleaning performance during a wash cycle.

FIG. 2 is a block diagram illustrating a method 200 of the invention. The method 200 may be a method to improve cleaning performance during a wash cycle.

At step 202, the method 200 may begin. Here, a load of clothes (usually dry) and a measured amount of detergent may be placed in the wash basket 20. Moreover, the settings on the console 42 may be established and a start button depressed.

At step 203, clothes and detergent may be added to the wash tub 12. At step 204, a small amount of liquid 52 may be added to the wash tub 12 through the flow valve 58. The liquid 52 may be added over a predetermined amount of time. This may help limit the amount of liquid 52 that enters the wash tub 12.

At step 206, the wash basket 20 may be spun. The spinning of the wash basket 20 may overlap the addition of the liquid 52. Thus, the wash basket 20 with the clothes load may be viewed as spinning simultaneously with the addition of the liquid 52 at step 204.

As liquid 52 enters the wash tub 12, the clothes load will absorb a first portion of the fresh water. A second portion of the fresh water will flow towards the tub sump 24 and will be extracted from the clothes load by centrifugal force. At some point in time, the liquid 52 will engage and mix with the detergent to form a wash bath solution. At this stage of the method 200, the wash bath solution may include a cleaning lather intermixed with a slurry of liquid 52 and detergent.

At step 208, the controller 40 may activate the pump 64 (if not already activated). Activating the pump 64 may extract or draw any liquid residing in the tub sump 24 into the recirculation system as recirculating wash liquid 86. At step 210, the recirculating wash liquid 86 may be sprayed from the spray nozzle 84 onto the clothes load.

As the wash basket 20 continues to spin, the slurry of liquid 52 and detergent will intermix due to centrifugal forces. Moreover, the act of spraying the recirculating wash liquid 86 onto the clothes load will create a cleaning lather out of the available liquid 52 and detergent. By limiting the amount of liquid 52 that enters the wash tub 12 for a given amount of detergent, the cleaning lather may be viewed as a concentrated cleaning lather or a high-concentration wash solution.

In addition, as the wash basket 20 continues to spin, the spinning action may pull the concentrated cleaning lather through the fabric of the clothes. Here, enzymes from the detergent may penetrate and loosen soils and stain in the clothes, even those soils and stains that may have been overlooked by the consumer.

In one embodiment, the motor 34 may spin the wash basket 20 at approximately 300 revolutions per minute (RPM). Here, signals from the controller 40 may pulse the motor 34 on and off to achieve the approximately 300 RPM spin speed. This speed is lower than the 420 RPM used to implement spray washing in conventional washers. Thus, in another embodiment, the motor 34 may spin the wash basket 20 at less than 420 RPM.

The signals from the controller 40 to the pump 64 may pulse the pump 64 so that the recirculating wash liquid 86 as a high-concentration wash solution may be sprayed over the clothes intermittently. For example, the controller 40 may pulse the pump 64 with interleaved 3-second spray-on and 3-second spray-off signals so that the high-concentration wash solution may be sprayed over the clothes intermittently. Unlike existing methods that spray continuously, this high-concentration wash solution preferably is sprayed over the clothes intermittently. Importantly, the combination of a lower spin speed and an intermittent spray pattern works to reduce the propensity to generate excessive suds.

At step 212, a sensor may determine whether the clothes are completely saturated with the high-concentration wash solution. If no, the method 200 may return to step 206, where the wash basket 20 may continue to spin. If yes, the method 200 may proceed to step 214.

At step 214, the wash basket 20 and the pump 64 may be stopped. At this point in the method 200, the centrifugal forces generated at step 206 will have plastered the clothes load against the side wall of the wash basket 20. Before performing an impeller wash (or an agitator wash), it is important to remove the plastered clothes load from the side wall of the wash basket 20.

One method to remove the clothes from the side wall is to use deep fill washing. Deep fill washing may involve thirteen to twenty gallons of water. However, the amount of water used in deep fill washing is a function of the washer scale and may be in a range of more or less than thirteen to twenty gallons of water.

Deep fill washing works to float and subsequently move the clothes away from the side wall of the wash basket 20 by rotation of the impeller 22. However, the large amount of water used during the deep fill washing reduces the detergent concentration available to wash clothes as well as represents a wasted resource. An alternate method to remove the clothes from the side wall is to use a fixed total water level that is much lower than used for a deep fill washing. This may work to pull the clothes away from the side wall of the wash basket 20 and down towards the impeller 22.

At step 216, the method 200 enters the clothes pull-down phase. At step 218, liquid 52 may be added to the wash tub 12. Ultimately, liquid 52 may be added to the wash tub 12 to a fixed total water level that is much lower than used for a deep fill washing. This works to provide a higher concentration of wash chemistry that is not possible during a normal deep fill washing. Here, the increased concentration works to improve cleaning performance. In one embodiment, the fixed total water level is 50% lower than used for a standard deep fill washing. In another embodiment, the fixed total water level is one to approximately five gallons and the deep fill washing is thirteen to twenty gallons.

At step 220, the method 200 may determine whether the liquid 52 has been added to the wash tub 12 to the fixed total water level. If the liquid 52 has been added to the wash tub 12 to the fixed total water level, the method 200 may proceed to step 224 to oscillate the impeller 22.

If the liquid 52 has not been added to the wash tub 12 to the fixed total water level, the method 200 may determine at step 222 whether to stop the addition of liquid 52 and oscillate the impeller 22. Stopping the addition of liquid 52 short of the fixed total water level and starting the impeller 22 would provide a concentration of wash liquid that is more concentrated than a combination of the detergent and the liquid 52 at the fixed total water level. If the method 200 determines to stop the addition of liquid 52 and oscillate the impeller 22, the method 200 may proceed to step 224. If the method 200 determines to continue the addition of liquid 52, the method 200 may return to step 218.

At step 224, the impeller 22 (sometimes referred to as an impeller plate) may be moved in an oscillating manner through fixed strokes of the motor 34. In one embodiment, the impeller 22 is oscillated using a fixed and symmetric motor rate for a specified amount of time. As example of symmetrical motor oscillation is shown in FIG. 3.

Figure 3:
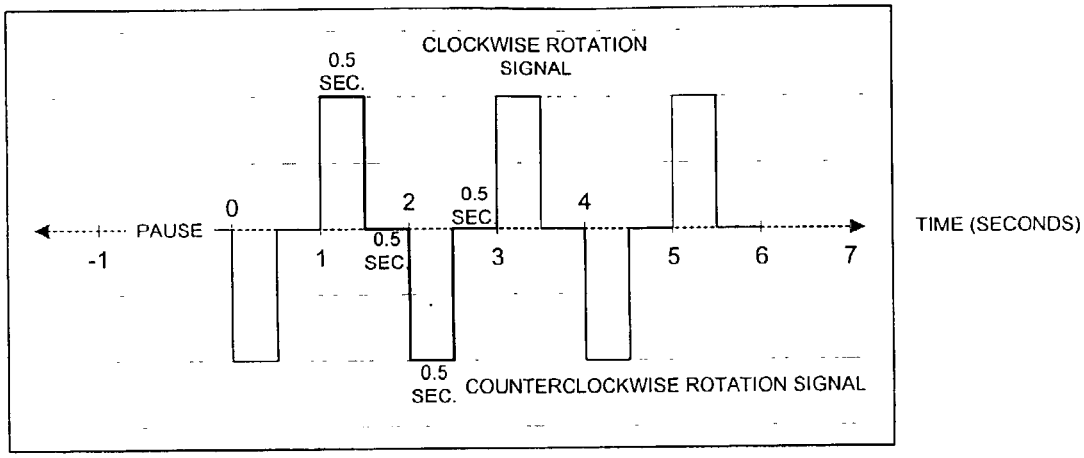
FIG. 3 is a graph that illustrates symmetrical motor oscillations that are constant for all periods.

FIG. 3 is a graph that illustrates symmetrical motor oscillations that are constant for all periods. As shown, the oscillation stroke rate having a 2.0 second fixed period may be represented by: a 0.5 second clockwise movement, a 0.5 second pause, a 0.5 second counterclockwise movement, and a 0.5 second pause. The oscillation stroke rate may be repeated for as much time as may be necessary to achieve cleaning performance.

Since an outer diameter of the impeller 22 generally will be larger than a diameter at a lower end of the raised center 28, those clothes near the bottom of the wash basket 20 may be engaged by the impeller 22 and the impeller protrusions 26 to move downward and inward. Accordingly, at step 226, those clothes near the bottom of the wash basket 20 may be engaged by the impeller 22 and the impeller protrusions 26 to move downward and inward. At step 228, wash liquid may be splashed against a lower layer of the clothes load by the oscillating impeller 22. This works to further aid the downward clothes movement.

Taken together, the reduced water fill at step 218 and the fixed strokes of the motor 34 at step 224 work to pull the clothes load plastered on the side wall of the wash basket 20 away from the side wall and down towards the impeller 22. At step 230, the method 200 determines whether the clothes load size is large. If the clothes load size is not large, then the method 200 may proceed to step 236. If the clothes load size is at least a predetermined size such as large, then the method 200 may proceed to step 232.

At step 232, the controller 40 may activate the pump 64 to extract or draw any liquid residing in the tub sump 24 into the recirculation system as recirculating wash liquid 86. At step 234, the recirculating wash liquid 86 may be sprayed from the spray nozzle 84 onto the clothes load. Here, the duration of the spray approximately may follow the duration of the oscillation stroke rate of the impeller 22 at step 224.

At step 236, the method 200 determines whether the duration of the oscillation stroke rate of the impeller 22 at step 224 has completed. If the duration has not completed, then the method 200 may return to step 224, where the impeller 22 continues to oscillate. If the duration has completed, then the method 200 proceeds to step 238.

At step 238, with the high-concentration wash step completed, the washer 10 may continue to fill with liquid 52 until the common water level of the invention is reached. Under circumstances where deep fill washing is approximately thirteen to twenty gallons, the common water level may be held to approximately eight gallons. At step 240, the wash cycle may proceed to completion.

The combination of pulling the clothes down from the side wall of the wash basket 20 through use of the impeller 22 and the recirculating wash liquid 86 from the spray nozzle 84 may impart enough chemical, mechanical, and thermal energy into the clothes load such that this phase of the method 200 may be considered as washing the clothes. In this context, the method 200 may be altered by, for example, stopping at least one of the impeller 22 and the pump 64 to allow the high-concentration of liquid wash to soak the clothes. Moreover, the impeller 22 may be cycled on and off at any step in method 200. Further, depending on the amount of cleaning desired through the method 200, the concentrated portion of the cycle could rest, agitate or oscillate for a time, continue to fill to the fixed total water level, recirculate the wash liquid over the clothes load, the wash basket 20 could be spun, or some combination of the foregoing prior to reaching step 240.

III. Common Water Level/Variable Clothes Load Wash Step

As noted in method 200, as soon as the concentration wash step completes at step 236, the method 200 may continue to fill the washer 10 with liquid 52 until the common water level of the invention is reached at step 238. In investigating this area, the inventors discovered that a single common water level could be used to achieve the desired rollover for small, medium, and large loads in an inverse toroidal system. This may be achieved by varying the impeller 22 oscillation cycles alone or by varying the impeller 22 oscillation cycles in combination with varying the recirculation duty cycles of the pump 64. Holding the water level constant from load to load by varying the oscillation pattern to achieve rollover motion is distinguished over prior techniques, which require that the water level be varied to achieve the desired rollover motion.

Beneficially, the common water level system of the invention uses a water level that is lower over the average than the average water levels used in most conventional vertical-axis washers. For example, this lower average water level allows for increased detergent concentration while exhibiting savings of water resources. Even with an increased detergent concentration and savings of water resources, laboratory testing by the inventors demonstrated that the common water level system of the invention showed no loss of performance as compared to other vertical-axis washers.

Generally, when a low-water system is subjected to a mechanical-to-chemical energy trade-off, the mechanical energy reduction needed for an impeller is less than the mechanical energy reduction needed for an agitator system. One reason for this is that a horizontally extending impeller may have small, raised protrusions that rotate under a low-water clothes load. Moreover, the low profile of an impeller causes less churning of the wash liquid and thus generates fewer suds. By way of contrast, a vertically extending agitator includes vanes that must power their way through a clothes load or must engage and rotate the entire low-water load, generally causing more suds. The inherent advantage of an impeller results in only a slight increase in torque required with low-water conditions. Thus, an impeller was preferred over an agitator in U.S. Pat. No. 6,212,722, and is preferred in the present invention as well.

Building on the lower torque and reduced suds advantage of an impeller over an agitator and the inverse toroidal rollover system of U.S. Pat. No. 6,212,722, the inventors of the present invention prototyped inverse toroidal impeller systems. Empirical tests examined the mechanical-to-chemical energy trade-off through investigation of three variables: load size, water level, and mechanical duty cycle, where mechanical duty cycle included the recirculation duty cycle and the impeller oscillation cycle.

For each of the tests, the washers 10 used in the tests employed a deep fill washing of approximately thirteen to twenty gallons. Here, the clothes load sizes were tested at 1.0 kilogram (kg) (2.2 pounds (lbs)), 3.0 kg (6.6 lbs), and 5.0 kg (11 lbs). These three sizes may represent typical small, medium, and large size clothes loads for washers 10 employing a deep fill washing.

After some trial and error and educated guesswork, the common water level in the wash tub 12 was selected as eight gallons of liquid 52. However, the common water level of the invention is not limited to eight gallons, but may change depending on the washer 10 employed or other variables. For example, the terms small, medium, and large size clothes loads are relative to the washer being employed. Industrial size washers may employ a large size clothes load of 50 kg (110 lbs). Under such circumstances, a common water level of eight gallons may not aid in providing sufficient energy to the clothes load to be considered as washing the clothes load. For different washers 10, the common water level could be maintained at different values.

A. Test No. 1

For test no. 1, the variables were as follows: load size (1.0 kg, 3.0 kg, and 5.0 kg); water level (8.0 gallons fixed); recirculation duty cycle (varied); and impeller oscillation cycle (fixed and symmetric).

Several observations were made during test no. 1. Using recirculation, each of the three load sizes could be fully saturated and clothes motion was achieved for each of the three load sizes. In fact, clothes motion occurred at water amounts lower than those set out in U.S. Pat. No. 6,212,722. The inventors also found that pulsing the recirculation duty cycle reduced the amount of suds generated and yet still resulted in fully saturated clothes that experienced clothes motion. For this test, soil clothes wash performance was comparable to other vertical-axis washers and over-sudsing in large loads was acceptable.

For larger loads, more recirculation on-time was needed. Also, the rollovers for larger loads were slower and fewer in number than for the smaller load sizes. It was surmised that one reason for this was the impeller oscillations were fixed and symmetric. None the less, this test was successful for larger loads since the desired rollover clothes motion was achieved.

B. Test No. 2

For test no. 2, the variables were as follows: load size (1.0 kg, 3.0 kg, and 5.0 kg); water level (8.0 gallons fixed); recirculation duty cycle (varied); and impeller oscillation cycle (varied).

As in the first test, each of the three load sizes was fully saturated and clothes motion was achieved for each of the three load sizes. However, by varying the oscillation cycle of the impeller 22 in addition to varying the recirculation duty cycle, the inventors discovered that the speed and number of clothes rollovers increased for small, medium, and even large clothes loads. In other words, varying the recirculation as in test no. 1 along with varying the impeller oscillation cycle allowed the small, medium, and large loads to exhibit the inverse toroidal motion more readily. For this test, soil clothes wash performance was comparable to other vertical-axis washers and over-sudsing in large loads was acceptable.

Varying the oscillation cycle of the impeller 22 may be broken down into random strokes and bi-modal strokes. Under random strokes, symmetric clockwise and counterclockwise impeller oscillations are varied randomly with each subsequent on/off/on/off period. Under bi-modal strokes, two alternating on/off/on/off period lengths for the symmetric clockwise and counterclockwise impeller oscillations are selected for variation. For every third on/off/on/off period, the system switches back to the first period length to switch between these two period lengths.

For the on/off/on/off random stroke periods, the controller 40 may be programmed to select from a set of periods. The set may include, for example, the values 0.8 seconds, 1.0 seconds, 1.6 seconds, 2.4 seconds, 2.8 seconds, 3.1423 seconds, 4.8 seconds, and 9.3 seconds. Randomly, for example, the processor or controller 40 may choose as the first sequence of four on/off/on/off periods: 1.6 seconds, 0.8 seconds, 0.8 seconds, and 2.4 seconds. Alternatively, the controller 40 randomly may choose as the first sequence of four on/off/on/off periods: 2.4 seconds, 3.1423 seconds, 0.8 seconds, and 1.6 seconds.

For the on/off/on/off 1.6 second period, the motor 34 may be on for 0.4 seconds to cause the impeller 22 to spin clockwise for 0.4 seconds. Then the motor 34 may be off for 0.4 seconds. Then the motor 34 may be on for 0.4 seconds to cause the impeller 22 to spin counterclockwise for 0.4 seconds. Last, the motor 34 may be off for 0.4 seconds. Once this 1.6 second period is completed, the clockwise, off, counterclockwise, off pattern may be repeated for the subsequent time periods randomly selected from the set of time periods by the controller 40.

In one embodiment, each subsequent period of the impeller oscillations was preprogrammed to vary the mechanical energy input into the system by the impeller 22. In another embodiment, each subsequent period of the impeller oscillations was randomly selected by the controller 40 from a predetermined set of time periods to vary the mechanical energy input into the system by the impeller 22. In a bi-modal embodiment, the controller 40 randomly may choose as the first four on/off/on/off periods: 1.0 seconds, 1.6 seconds, 1.0 seconds, and 1.6 seconds.

C. Method 400

Figure 4:
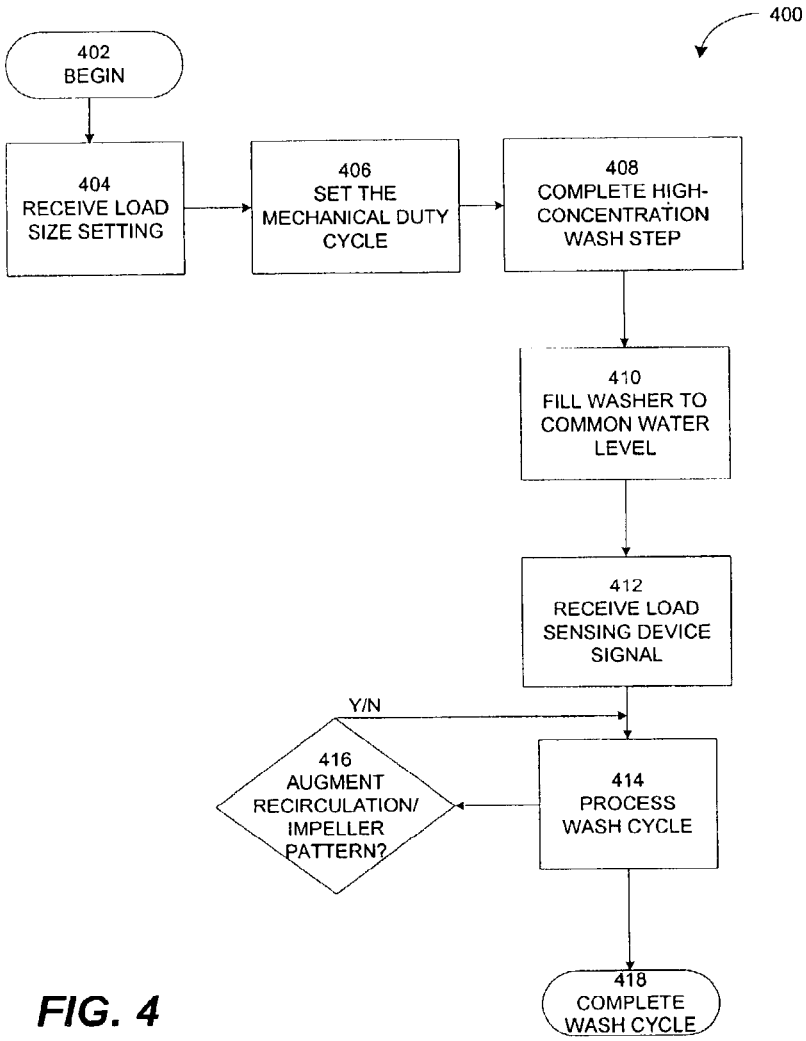
FIG. 4 is a block diagram illustrating a method 400 of the invention to wash varying clothes loads with the same level of water.

FIG. 4 is a block diagram illustrating a method 400 of the invention to wash varying clothes loads with the same level of water. At step 402, the method 400 may begin. Here, a load of clothes (usually dry) and a measured amount of detergent may be placed in the wash basket 20. Moreover, the settings on the console 42 may be established and a start button depressed. In particular, a consumer may set the load size by engaging load size setting 44 on the console 42.

At step 404, the controller 40 may receive the load size setting 44 as a signal. At step 406, the mechanical duty cycle may be set. Here, the controller 40 may set the mechanical duty cycle based on the load size setting 44 input by a consumer. Recall that the mechanical duty cycle includes the recirculation duty cycle and the impeller oscillation cycle. Thus, the controller 40 may select a particular predetermined combination of recirculation duty cycles and variable impeller oscillation patterns for a pre-established common water level.

Importantly, a single setting may then be used by the controller 40 to select a particular combination of recirculation duty cycles and variable impeller oscillation patterns for the pre-established common water level. By using a common water level, the present invention may avoid the expense of relying on the load sensing device 88 to control water level, as is conventionally the situation.

At step 408, the high-concentration wash of method 200 may complete. At step 410, the washer 10 may continue to fill with liquid 52 until the common water level of the invention is reached.

In an alternate embodiment, the load sensing device 88 may be included with the washer 10. Here, the controller 40 may receive information after the completion of the high-concentration wash step 408. This information may be used to augment the selection of the recirculation duty cycles and the variable impeller oscillation patterns to promote the best rolling motion for a particular sensed load size. Thus, at step 412, the controller 40 may receive a signal from the load sensing device 88 or from other load sensing devices.

At step 414, the wash cycle process may proceed. At step 416, the controller 40 may determine whether to augment the patterns of at least one of the recirculation duty cycles and the variable impeller oscillation patterns. Augmenting the patterns of at least one of the recirculation duty cycles and the variable impeller oscillation patterns may involve the controller 40 receiving a signal from the load sensing device 88 such as at step 412.

Step 416 maybe a determination that is ongoing with the wash cycle at step 414. Thus, the method 400 may return to step 414 from step 416 whether or not the recirculation or impeller patterns are augmented. Once the wash cycle is complete at step 414, the method 400 may proceed to step 418. At step 418, the wash cycle may complete.

D. General Observations

The mechanical-to-chemical energy trade-off of the invention was successful in achieving low-suds and clothes motion by adjusting the actions of the impeller 22 and the pump 64 without changing the water level as a function of clothes load size. There are several reasons for this. For example, rather than relying on one mechanical subsystem, the invention adjusts the energy input from two or more mechanical subsystems. By altering the recirculation duty cycle and the impeller oscillation cycle, the inventors were able to discover an optimal combination.

Another reason for the invention's successful mechanical-to-chemical energy trade-off is that the preferred embodiment employed an impeller low-water system rather than an agitator low-water system. When the water level was decreased to the common water level of the invention, the impeller low-water system was found less susceptible to an increase in torque, even for the larger loads. With less concern for the torque on the impeller 22, the invention allows greater flexibility in designing a low-suds, low-torque wash cycle.

Moreover, another reason for the invention's successful mechanical-to-chemical energy trade-off is that the variable impeller oscillations allowed a lower average input energy to the wash bath. This, in turn, controlled suds in small loads. This variation also allowed a higher average input energy to the wash bath with larger loads and permitted a greater flexibility in selecting the variable range of input energy to the large loads. This shift to higher and more variable input power worked to achieve robust motion in larger and more complex loads.

IV. Conclusion

In the system of the invention, the fixed, common water level may be used regardless of clothes load size. Being a lower water level per cycle than that used in conventional systems, this lower water level increases chemical concentration (chemical energy) inside wash baths.

The washing technique of the invention may make the washer 10 more robust to consumer mistakes. Conventionally, if the consumer selected a small load at the load size setting 44 when in fact the load was a large load, the large load will not move effectively. However, if the consumer makes the same mistake in a washer employing the common water level of the present invention, the control settings for smaller clothes loads (i.e., the variable impeller oscillation and recirculation profiles) will still provide clothes motion that gives some measure of wash, even if the clothes motion is not optimal.

A common, fixed fluid level may be used to wash small, medium, and large size clothes loads in a washer having an impeller. Modifications to the impeller oscillation and the recirculation duty cycles may be used to promote clothes motion in varied-size loads and to reduce suds generation. These parameters may be adjusted to compensate for varying load sizes, instead of adjusting the water level as is conventionally done. This lack of water level adjustment works towards reducing the overall amount of water used by the consumer, reduce cost, and provide for increased performance via increased concentration. Consumer costs and environmental impact accordingly may be reduced.

In the United States, the federal government performs energy cost tests for individual washers by assuming that the consumer has selected a hot wash, hot rinse wash cycle for a full wash load. Under such tests, energy costs are largely a function of the energy used to heat the water volume in the hot wash, hot rinse wash cycle. Here, electricity costs used to drive the motor are a small fraction of energy used to heat the water during a wash cycle. Thus, the reduction in water usage by the invention allows for significant savings in these tests.

The present invention has been described utilizing particular embodiments. As will be evident to those skilled in the art, changes and modifications may be made to the disclosed embodiments and yet fall within the scope of the present invention. The disclosed embodiments are provided only to illustrate aspects of the present invention and not in any way to limit the scope and coverage of the invention. The scope of the invention is therefore only to be limited by the appended claims.

The embodiments of the invention in which an exclusive property or privilege is claimed are defined as follows:

1. A method of washing a clothes load comprising one or more articles of clothing in a clothes washer comprising a controller and a wash basket of a predetermined capacity and capable of holding any size clothes load up to the predetermined capacity of the wash basket, the method comprising:

determining the size of a clothes load in the wash basket;

setting a mechanical duty cycle based on the determined size of the clothes load;

filling the washer with a consistent volume of liquid regardless of the clothes load size setting signal or liquid level setting signal; and completing a wash cycle.

2. The method of claim 1, where setting a mechanical duty cycle comprises setting at least one of a recirculation duty cycle and an impeller oscillation cycle.

3. The method of claim 2, where setting the recirculation duty cycle comprises pulsing a recirculation pump.

4. The method of claim 2, where setting the impeller oscillation cycle comprises employing a fixed and symmetric impeller oscillation cycle.

5. The method of claim 2, where setting the impeller oscillation cycle comprises varying the impeller oscillation cycle.

6. The method of claim 5, where varying the impeller oscillation cycle comprises employing random strokes.

7. The method of claim 6, where employing random strokes for the impeller oscillation cycle comprises employing bi-modal strokes.

8. The method of claim 1, where determining the size of a clothes load in the wash basket comprises receiving a clothes load size signal in the controller from at least one of a load sensing device and a setting on a console, the method further comprising:

augmenting the mechanical duty cycle as a function of the determined size of the clothes load.

9. The method of claim 1, prior to filling the washer with said consistent volume of liquid, the method comprising:

performing a high-concentration wash step.

10. The method of claim 9, where performing the high-concentration wash step comprises spraying wash liquid over a clothes load in a wash basket of the washer while spinning the wash basket until the clothes load is saturated with the wash liquid; and pulling down the clothes load from a side of the wash basket.

11. The method of claim 9, where pulling down the clothes load from a side of the wash basket comprises increasing the amount of wash liquid in a wash tub of the washer by adding fresh liquid to the wash tub, and oscillating an impeller of the washer.

12. The method of claim 11, where oscillating an impeller of the washer comprises splashing a lower layer of the clothes load with the wash liquid.

13. The method of claim 9, where performing a high-concentration wash step comprises determining whether the clothes load is at least a predetermined size, and if the, clothes load is at least the predetermined size, then spraying the clothes load with the wash liquid.

14. The method of claim 13, where performing a high-concentration wash step further comprises oscillating an impeller of the washer, and determining whether a predetermined duration for oscillating the impeller has been reached, and if the predetermined duration for oscillating the impeller has not been reached, then continuing to oscillate the impeller.

15. A method of washing a clothes load comprising one or more articles of clothing in a clothes washer comprising a controller and a wash basket of a predetermined capacity and capable of holding any size clothes load up to the predetermined capacity of the wash basket, the method comprising:

determining the size of a clothes load in the wash basket;

setting a mechanical duty cycle based on the determined size of the clothes load;

spraying wash liquid over a clothes load in the wash basket of the washer while spinning the wash basket until the clothes load is saturated with the wash liquid;

pulling down the clothes load from a side of the wash basket;

filling the washer with a consistent volume of liquid regardless of the clothes load size setting signal or liquid level setting signal; and completing a wash cycle.

16. The method of claim 15, where pulling down the clothes load from a side of the wash basket comprises increasing the amount of wash liquid in a wash tub o£ the washer by adding fresh liquid to the wash tub, and oscillating an impeller of the washer.

17. The method of claim 16, where oscillating an impeller of the washer comprises splashing a lower layer of the clothes load with the wash liquid.

18. The method of claim 15, where pulling down the clothes load from a side of the wash basket comprises determining whether the clothes load is at least a predetermined size, and if the clothes load is at least the predetermined size, then spraying the clothes load with the wash liquid.

19. The method of claim 15, where pulling down the clothes load from a side of the wash basket comprises oscillating an impeller of the washer, determining whether a predetermined duration for oscillating the impeller has been reached, and if the predetermined duration for oscillating the impeller has not been reached, then continuing to oscillate the impeller.

20. The method of claim 15, where setting a mechanical duty cycle comprises setting at least one of a recirculation duty cycle and an impeller oscillation cycle.

21. The method of claim 20, where setting the recirculation duty cycle comprises pulsing a recirculation pump and where setting the impeller oscillation cycle comprises employing a fixed and symmetric impeller oscillation cycle.

22. The method of claim 21, where setting the impeller oscillation cycle comprises varying the impeller oscillation cycle.

23. The method of claim 22, where varying the impeller oscillation cycle comprises employing random strokes.

24. The method of claim 15, where determining the size of a clothes load in the wash basket comprises receiving a clothes load size signal in the controller from at least one of a load sensing device and a setting on a console, the method further comprising:

augmenting the mechanical duty cycle as a function of the determined size of the clothes load.

25. A method of washing a clothes load comprising one or more articles of clothing in a vertical axis impeller washer having a controller and configured to achieve rollover motion of a clothes load during a wash cycle and a wash basket of a predetermined capacity capable of holding any size clothes load up to the predetermined capacity of the wash basket, the method comprising:

determining the size of a clothes load in the wash basket;

setting an impeller oscillation cycle based on the determined size of the clothes load;

filling the washer with a consistent volume of liquid regardless of the clothes load size setting signal or liquid level setting signal; and achieving rollover motion of the wash load by varying the oscillation cycle of the impeller.

26. The method of claim 25, where setting the mechanical duty cycle further comprises setting a recirculation duty cycle for pulsing a recirculation pump.

* * * * *